United States Patent [19]

Stangroom

[11] Patent Number: 4,532,853

[45] Date of Patent: Aug. 6, 1985

[54] FLUID-POWERED ACTUATORS

[75] Inventor: James E. Stangroom, Castleton, England

[73] Assignee: The Secretary of State for Defence in Her Britannic Majesty's Government of the United Kingdom of Great Britain and Northern Ireland, London, England

[21] Appl. No.: 193,491

[22] Filed: Oct. 8, 1980

[30] Foreign Application Priority Data

Oct. 24, 1979 [GB] United Kingdom ..... 7936927

[51] Int. Cl.[3] ..... F01B 5/00

[52] U.S. Cl. ..... 91/165; 91/172; 91/178; 137/807; 137/827; 244/3.21

[58] Field of Search ..... 60/326; 91/166, 463, 91/165, 172, 178; 102/384, 385; 137/807, 827, DIG. 10; 244/3.21, 3.24

[56] References Cited

U.S. PATENT DOCUMENTS

| | | | |
|---|---|---|---|
| 2,651,258 | 9/1953 | Pierce | 60/326 |
| 3,416,549 | 12/1968 | Chaney et al. | 137/827 |
| 3,711,040 | 1/1973 | Carver | 244/3.24 |

*Primary Examiner*—Stephen C. Bentley

*Attorney, Agent, or Firm*—Pollock, Vande Sande and Priddy

[57] ABSTRACT

An actuator output member (11) is angularly deflectable by two opposed, tangentially movable, pressure transmitting members (7, 8), each responsive to the pressure drop developed across two respective flow restrictors (1, 2) serially connected in a fluid circuit. Deflection is achieved by variation of one or both of the flow restrictors. In a fast response arrangement the fluid is electroviscous and the flow restrictors electrically variable.

9 Claims, 4 Drawing Figures

Figure 2:
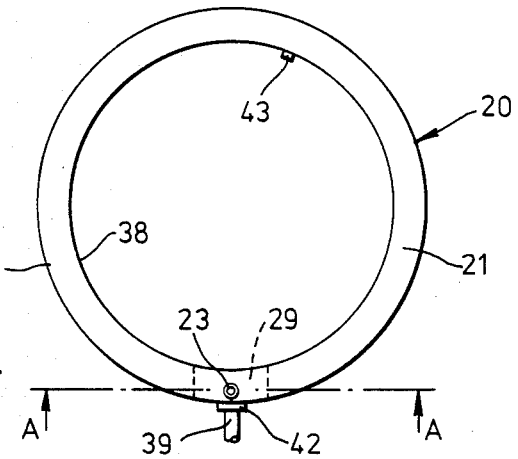

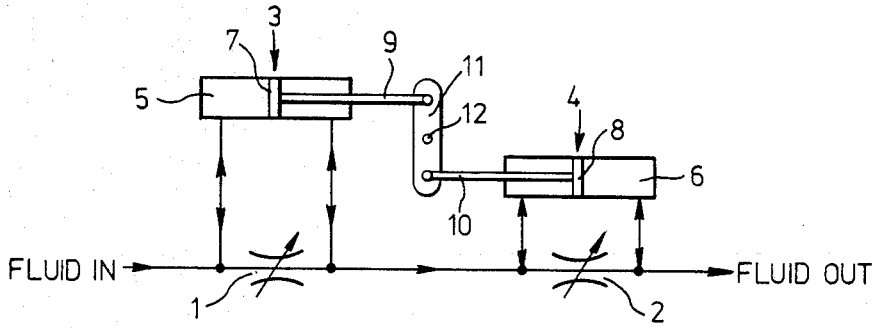
Fig. 1.
Fig. 4.
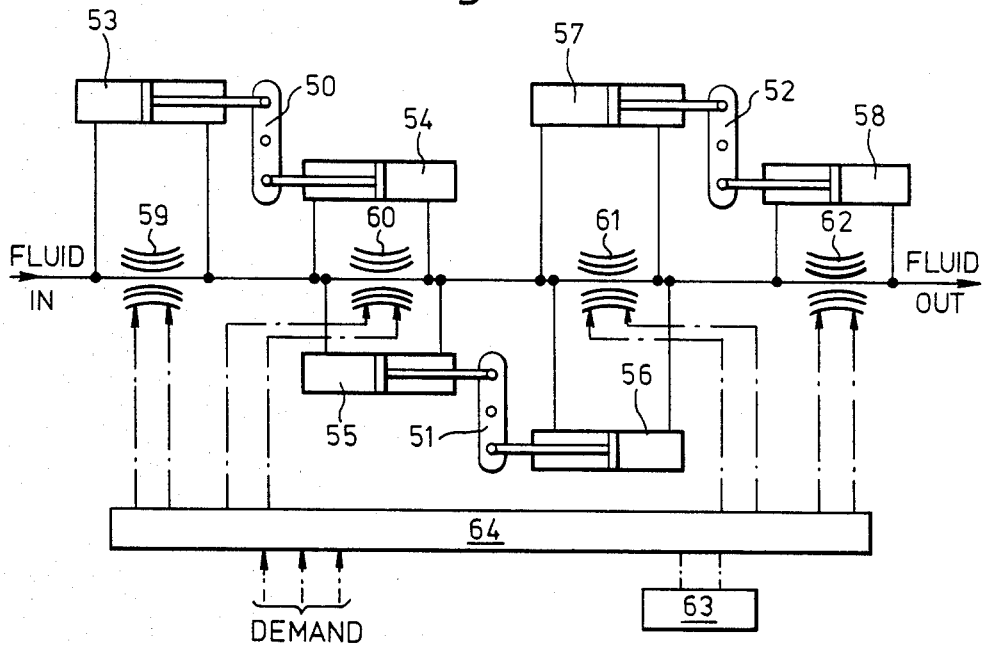

FLUID-POWERED ACTUATORS

This invention relates to fluid-powered actuators having an angularly deflectable output element and in particular to an electrically controlled actuator powered by an electroviscous fluid. The invention is particularly applicable to weapon guidance systems.

The majority of known fluid-powered actuators are bulky, require hydraulic control valves of close dimensional tolerances and are fairly slow in action, due to the inertia effects of the moving parts of the control valves and of the fluid itself.

Actuators for weapon guidance systems need to be fast in action, readily interfaced with electrical controls and able to make use of fluid power sources available in the weapon, such as high pressure gas from the rocket motor efflux.

Electroviscous devices comprising electroviscous fluid flow paths in which the shear resistance of the fluid is varied by the application of an electric field, are particularly suitable in guidance systems as they can be conveniently powered by high pressure fluid, do not demand the close dimensional tolerances of conventional hydraulic valves and are electrically controllable.

Some fast-response actuators using electroviscous devices have been designed in which fluid inertia effects are eliminated by keeping the overall fluid flow rate constant, UK patent application No. 47545/78 for example, in which two opposed-flow electroviscous valves actuate a common linearly movable core. The bulky linear configuration of such actuator is not easily fitted into the limited space available in a missile however, where in addition its linear movement must be adapted to rotative movement, thus further increasing bulk.

The present invention seeks to provide a fast response fluid-powered actuator capable of rotative motion.

In accordance with the present invention, a fluid-powered actuator includes:

At least one pair of flow restrictors, at least one restrictor of the pair being variable, arranged for series flow connection in a fluid circuit;

a fluid pressure transmitting means arranged for parallel flow connection with each flow restrictor, having a linearly movable transmitting member responsive to the differential fluid pressure developed in use across the restrictor, the two transmitting members respective to each restrictor pair being mutually disposed for movement tangential to a common axis; and an output member rotatable about each common axis, opposingly coupled to the two respective transmitting members so as to be angularly deflected by differential movement of the said two members.

The two flow restrictors are preferably both viscous resistances, across which the differential fluid pressure developed varies linearly with fluid flow rate.

Preferably the fluid circuit is electroviscous and the variable flow restrictor is an electroviscous flow restrictor comprising an array of laminar electrodes between which the electroviscous fluid flows, variable voltages being applicable across the electrodes so as to vary the shear resistance of the electroviscous fluid and hence vary the pressure drop engendered by the restrictor.

The fluid pressure transmitting means may be a double-acting cylinder containing a piston comprising the movable transmitting member. Alternatively, the fluid pressure transmitting means may be a double-ended chamber sub-divided by a flexible diaphragm comprising the transmitting member.

Multiple arrangements of actuators according to the present invention may include a series-connected multiplicity of flow restrictors, at least alternate ones of which are variable, operative upon a like multiplicity, less one, of output members, each intermediate restrictor in the series being co-operative with the preceding restrictor and with the following restrictor via parallel-connected fluid pressure transmitting means, to drive two separate output members.

Figure 3:
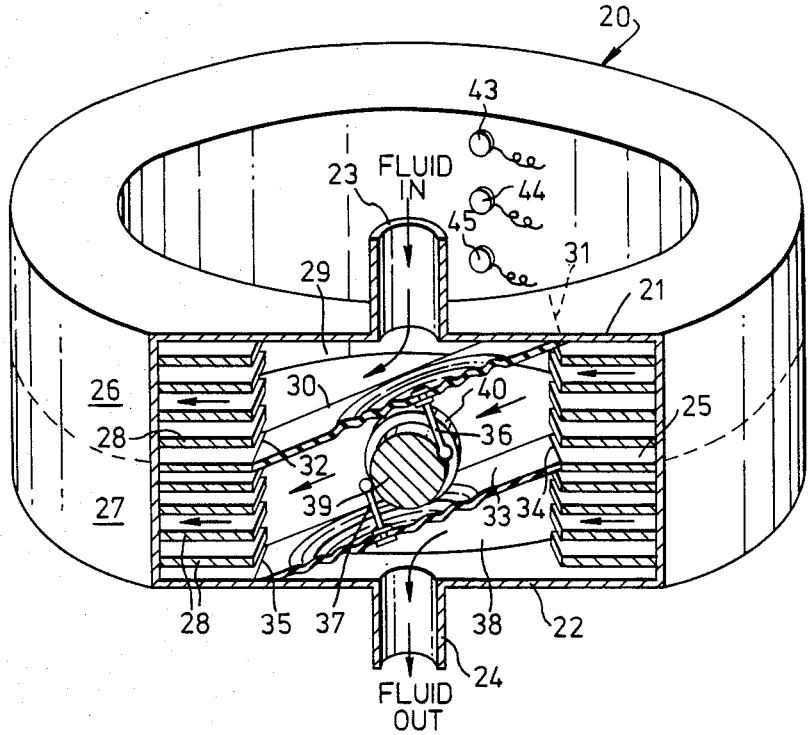

Embodiments of the invention will now be described by way of example only with reference to the accompanying drawings of which FIG. 1 is a symbolic representation of the principle underlying the invention, FIG. 2 is a plan view of an electroviscous fluid actuator of annular configuration, FIG. 3 is a perspective view of the same actuator sectioned at the line AA of FIG. 2, and FIG. 4 is a symbolic representation of a multiple actuator arrangement.

The actuator arrangement represented in FIG. 1, comprises a first flow restrictor 1 which is variable, arranged in series connection with a second flow restrictor 2 which may be variable or fixed. Connected in parallel with the flow restrictors 1 and 2 are fluid pressure transmitting means 3 and 4, here represented as double acting cylinders 5 and 6 respectively containing pistons 7 and 8 comprising the linearly movable transmitting members. These transmitting members could equally well be flexible diaphragms transversely sealed in the cylinder.

Piston rods 9 and 10 are attached to the pistons 3 and 8 respectively and both articulated to an output member 11 rotatable about a fixed pivot 12. In a practical arrangement, the two cylinders 5 and 6 may be conjoint at their mutually coupled ends and the output member mounted within the fluid, thereby to reduce the number of fluid seals required, and their attendent friction losses.

In operation, when the flow resistance of the restrictor 1 is adjusted to be equal to that of the restrictor 2, there is an equal fluid pressure drop across both restrictors and equal forces are exerted on the pistons 7 and 8 to drive them both in the same direction (left to right as illustrated). The resulting torques exerted about the pivot 12 are equal and opposite and there is therefore no rotation of the output member 11.

If the flow resistance of the restrictor 1 is then increased, the force exerted upon the piston 7 becomes greater than that on the piston 8 and the output member 11 is rotated in a clockwise direction. Conversely if the resistance of the restrictor 1 is decreased, the output member 11 is rotated in an anti-clockwise direction.

When only the restrictor 1 is varied, the resulting changes in its flow resistance will of course cause the overall flow rate through the actuator to vary. In applications where a constant flow rate is preferable, both the restrictors 1 and 2 are made variable, their respective flow resistances being opposingly varied so as to maintain a constant overall flow rate. Operation of the actuator is similar to that occuring when only the restrictor 1 is varied, except that both the pistons 7 and 8 contribute equally and oppositely to the rotation of the output member 11.

It will be apparent that if an electroviscous fluid is used in the fluid circuit the variable flow restrictors can be electrically controlled electroviscous flow restrictors. When electroviscous fluid is used, the fluid pressure transmission members are preferably sealed diaphragms, so that contamination of the fluid, such as might be introduced through the linear sliding seals of a piston rod, can be avoided.

The optimum size of an electroviscous flow restrictor is dictated by the pressure of the fluid supply, and when that pressure is high, the restrictors must necessarily be of long path length and small cross section in order to achieve adequate flow control. Consequently a linear arrangement of the restrictor is not practicable for a fast-response actuator, as the column of fluid that must be moved by the fluid pressure transmitting member would need to be as long as the restrictor, with resultant impairment of the response time. It is therefore desirable that the two ends of the restrictor should be located as closely together as possible to ensure fast response in high pressure applications.

An embodiment of the invention suitable for use in a high pressure electroviscous fluid system is illustrated in FIGS. 2 and 3. In this embodiment the actuator consists of an annular housing 20 having two end faces 21 and 22 (upper and lower as drawn) provided respectively with an inlet port 23 and an outlet port 24. The housing 20 is transversely divided by a gapped annular divider 25 into two identical restrictor compartments 26 and 27, each containing an axially spaced stack of gapped annular electrode plates 28, electrically insulated from each other and mutually disposed with the gapped divider 25 so as to provide a common gap 29 in axial alignment with the inlet port 23 and the outlet port 24.

A flexible diaphragm 30 having its upper edge 31 attached to the end face 21 and its lower edge 32 attached to the divider 25 is sealed across the full radial width of the gap 29, so as to separate the two opposing ends of the upper flow restrictor compartment 26. A second flexible diaphragm 33 is similarly sealed across the full radial width of the gap 29 with its upper edge 34 attached to the divider 25 and its lower edge 35 attached to the end face 22, so as to separate the two opposing ends of the lower flow restrictor compartment 27.

Drive links 36 and 37 attached to the diaphragms 30 and 33 respectively are articulated to an output shaft 39 rotatably mounted in bearings 40 so as to extend radially across the gap 29 intermediate the two diaphragms, the bearings being attached to the two opposing sidewalls 38 and 41 of the housing 20. The output shaft 39 protrudes through the outer bearing 40 and the sidewall 41 via a rotatable seal 42.

Alternate electrode plates 28 in the flow restrictor compartment 26 are electrically connected together so as to provide two interleaved sets inside the compartment (not shown), the two sets being respectively coupled to voltage input terminals 43 and 44. Similarly, alternate electrode plates 28 in the flow restrictor compartment 27 are connected as two interleaved sets and respectively coupled to the voltage input terminal 44 and a third voltage input terminal 45.

In operation, electroviscous fluid is forced through the actuator in a clockwise direction (as drawn) via the inlet port 23, restrictor compartments 26 and 27 in turn, and the outlet port 24. Equal and opposite input voltages are applied across the teminals 43/44 and 44/45 so as to vary opposingly the shear resistance of the electroviscous fluid flowing through the two restrictor compartments 26 and 27. Equal and opposite fluid pressure differentials are thereby developed cross the two diaphragms 30 and 33 causing them both to deflect inwardly towards or outwardly from the output shaft 39 so as to rotate it in a clockwise or an anti-clockwise direction dependent upon the polarity of the applied input voltages.

The two terminals 43 and 45 may be respectively connected to the two supply terminals of a voltage source (not shown) and the terminal 44 connected to the wiper of a potentiometer (not shown) also connected across the source so as to vary opposingly the voltage applied to the upper and lower flow restrictors. As these restrictors are essentially capacitive loads upon the voltage source such manner of connection ensures that the discharge current of one restrictor always contributes to the charging current of the other, thereby improving the overall response rate of the actuator. Alternatively the potentiometer may be replaced by a pair of output devices operating in push-pull (not shown) with similar effect.

This embodiment is particularly advantageous in that it provides flow restrictors of small cross section and long path length suitable for high pressure fluid systems, in combination with fluid pressure transmitting members of large cross section and short movement thus minimising fluid inertia effects which would otherwise impair the response time. Furthermore, because no fluid pressure differentials are exerted upon the electrode plates 28 themselves, they they can be extremely thin, thus minimising weight. The annular configuration of the actuator makes it mountable in space readily available adjacent the outer surface of a guided weapon, the high pressure electroviscous fluid required to power the actuator being conveniently supplied from a reservoir by means of a conventional rocket motor efflux 'blowdown' system.

It will of course be apparent that the restrictor flow paths of the embodiment could equally well conform to other configurations convenient for specific applications.

For applications requiring more than one actuator, such as the several control surfaces of a guided weapon, some sharing of flow restrictors is possible, thus saving space and cost. One such multiple arrangement is indicated in FIG. 4. In this multiple arrangement three output members 50, 51 and 52 are driven by three pairs of fluid pressure transmitting means 53 to 58 arranged in parallel flow connection with overlapped sequential pairs of electroviscous fluid flow restrictors 59 to 62. Correlation of the voltages to be applied to each electroviscous flow restrictor from a voltage source 63 is provided by a logic means 64 in response to incoming electrical demand signals. It will be apparent that the arrangement can be extended to comprise any number "n" of output members served by "n+1" flow restrictors and that further economy can be achieved by using fixed flow restrictors alternately with variable flow restrictors. It is also possible to set up various inter-relationships between the "n" output members by coupling each one with any selected two flow restrictors and their associated fluid pressure transmitting means.

The actuators of such "over-lapped" series arrangements inevitably have inter-dependent action which must be evaluated by the logic means 64 to derive the necessary command voltage signals for issuance to the individual flow restrictors. In the FIG. 4, if $S_p$ represents the supply pressure applied across the whole chain of flow restrictors; $p_{59}$ to $p_{62}$ the actual pressure drop in the respective flow restrictors 59 to 62; and $\pm D_{50}$ to $\pm D_{52}$ the demanded pressure drop across the respective output members 50 to 52; then the following four conditions must be simultaneously satisified:

$$p_{59}+p_{60}+p_{61}+p_{62}=S_p$$

$$p_{59}-p_{60}=\pm D_{50}$$

$$p_{60}-p_{61}=\pm D_{51}$$

$$p_{61}-p_{62}=\pm D_{52}$$

The relationship between the pressure drop (p) in an electroviscous flow restrictor and the applied voltage (v) is linear above a given threshold value (A), ie $p=A+Bv$ where B is a constant. It is this linear relationship, together with the four simultaneous equations above, that is used by the logic means 64 to determine the four command voltages necessary for application to the respective flow restrictors.

It will be obvious to those skilled in the art that any actuator that is dependent upon the viscosity of its actuating fluid for its operation will be sensitive to temperature changes. This is of particular relevance in guided missiles where gross temperature changes may well be encountered. Embodiments of the present invention having two opposingly variable flow restrictors are especially advantageous in this respect as temperature induced viscosity changes are completely balanced out. Embodiments employing one variable and one fixed flow restrictor do not have this in-built cancellation effect but an acceptable degree of compensation may be achieved by the addition of a temperature dependent flow rate controller connected in series with the actuator. For example a device having a variable bore controlled by the expansion and contraction of a flexible sealed capsule may be employed.

I claim:

1. A fluid powered actuator including:

at least one pair of flow restrictors, at least one restrictor of the pair being variable, arranged for series flow connection in a fluid circuit;

a fluid pressure transmitting means arranged for parallel flow connection with each flow restrictor, having a linearly movable transmitting member responsive to the differential fluid pressure developed in use across the restrictor, the two transmitting members respective to each restrictor pair being mutually disposed for movement tangential to a common axis; and an output member rotatable about each common axis, opposingly coupled to the two respective transmitting members so as to be angularly deflected by differential movement of the said two members.

2. An actuator as claimed in claim 1 wherein said fluid pressure transmitting means comprises a double-acting cylinder and piston arrangement, the piston comprising said movable transmitting member.

3. An actuator as claimed in claim 1 wherein said fluid pressure transmitting means comprises a chamber having two ends open to the fluid circuit, sub-divided by a flexible diaphragm intermediate the two ends, the diaphragm comprising said movable transmitting member.

4. An actuator as claimed in claim 1 wherein said flow restrictors are viscous resistances.

5. An actuator as claimed in claim 1 wherein said fluid circuit is electroviscous and said variable flow restrictors are electrically variable.

6. An actuator as claimed in claim 5 wherein said variable flow restrictors each comprise a multiplicity of parallel flow paths defined by laminar electrodes between which potential differences are applicable.

7. An actuator as claimed in claims 3 or 6 wherein the flow paths of each flow restrictor pair are annular and said electrodes comprise gapped annuli serially disposed in an annular housing, the gaps in the electrodes being juxtaposed so as to define a longitudinal chamber within the housing and the respective flexible diaphragms being serially disposed within the said chamber.

8. An actuator as claimed in claim 1 having a plurality of output members driven by a series of flow restrictors, wherein successive restrictors in the series are paired with both the preceding and the succeeding restrictor, thereby providing that the number of restrictors need not exceed the number of output members by more than one.

9. An actuator as claimed in claim 8 having logic means for applying command voltages to each flow restrictor in said series so as to actuate each output member individually.

* * * * *